US005253540A

United States Patent [19]

Sanders et al.

[11] Patent Number: 5,253,540

[45] Date of Patent: Oct. 19, 1993

[54] LAWN MOWER STARTING AID

[76] Inventors: Charles M. Sanders; Douglas E. Sanders, Sr., both of R.R. 3, Box 1134, King George, Va. 22485

[21] Appl. No.: 944,413

[22] Filed: Sep. 14, 1992

[51] Int. Cl.[5] ..... F02N 3/02

[52] U.S. Cl. ..... 74/6; 74/140; 123/185.4

[58] Field of Search ..... 74/6, 7 R, 140; 123/184.4, 184.5

[56] References Cited

U.S. PATENT DOCUMENTS

| | | | |
|---|---|---|---|
| 1,004,984 | 10/1911 | Buress | 123/185.4 |
| 1,211,605 | 1/1917 | McDonnell | 74/140 |
| 3,174,471 | 3/1965 | Weglage et al. | 123/185.5 |
| 3,754,543 | 8/1973 | Harkness | 123/185 B |
| 4,047,440 | 9/1977 | Carriera | 74/6 |
| 4,068,644 | 1/1978 | Newport | 123/185 BA |
| 4,109,538 | 8/1978 | Glenday et al. | 74/6 |
| 4,291,654 | 9/1981 | Obermayer | 123/185 BA |
| 4,569,315 | 2/1986 | Bodnar | 123/179 SE |
| 4,716,868 | 1/1988 | Reuter | 123/185 S |
| 4,744,257 | 5/1988 | Yagasaki et al. | 74/6 |
| 4,850,233 | 7/1989 | Ishigo | 74/6 |
| 4,909,200 | 3/1990 | Sumi | 123/179 P |
| 5,174,166 | 12/1992 | Tryon et al. | 74/6 |

*Primary Examiner*—Allan D. Herrmann
*Assistant Examiner*—David W. Laub
*Attorney, Agent, or Firm*—Norman B. Rainer

[57] ABSTRACT

A device for pulling the starter cord of a lawn mower engine utilizes a pulling cable disposed about upper and lower pulleys on a vertical post. The upper extremity of the pulling cable is attached to a lever pivotally joined to the vertical post. Downward movement of the lever causes the starter cord to be pulled horizontally.

3 Claims, 2 Drawing Sheets

LAWN MOWER STARTING AID

BACKGROUND OF THE INVENTION

1. Field of the Invention

This invention relates to apparatus for effecting a starting pull upon the rope of a recoil-start type internal combustion engine.

2. Description of the Prior Art

Small internal combustion engines in the range of 2-10 horsepower are commonly used upon various types of wheeled machines such as lawn mowers, snow blowers, roto-tillers, edgers, cement mixers, generators, air compressors, etc. Such engines typically consist of one or two cylinders and may have an output shaft oriented in either horizontal or vertical disposition.

Numerous starter devices for small engines have been disclosed in the prior art. For example, electric starter motors have been adapted to crank small engines. However, electric starters are expensive and require considerable maintenance. Various auxiliary starters have been employed in attempts to aid in the starting of stubborn engines. For example, U.S. Pat. No. 4,569,315 to Bodnar discloses an electric drill operated device adapted to engage a shaft associated with a small engine. Such devices are of limited adaptability with respect to various engine designs. The benefits of using such devices are diminished because of the measures needed to adapt the starting device to the requirements of the engine.

Crank-spring type starters such as disclosed by U.S. Pat. No. 4,716,868 to Reuter have been disclosed. Such starters store mechanical energy from a hand crank, said energy being subsequently released by a rachet and pawl. Starters of this type are prone to mechanical failure and therefore are seldom installed upon modern small engines.

The vast majority of small engines currently produced are adapted with a rope-pull-recoil starter such as disclosed in U.S. Pat. No. 4,850,233 to Ishigo. Recoil rope starters utilize a rope wound upon a spool by a recoil spring. The spool is usually geared for mechanical advantage to a clutch which engages an input shaft. The force exerted by a pull upon the rope causes engagement of the clutch, producing rotation of the spool and input shaft, which in turn cycle the engine in order to start it. Upon release of force upon the rope, it is recoiled upon the spool by a recoil spring.

Recoil starting devices having either vertical or horizontal pull strokes have been disclosed. Devices requiring a vertical pull generally utilize the force of gravity to stabilize the machine while the rope is pulled. Often the weight of the machine is great enough to overcome the resistance to the rope pull exerted by the engine cylinder compression upon starting. Some machines are adapted to be stepped upon while starting to further stabilize the machine and provide greater starting force by the person pulling the rope.

However, machines which have a horizontal-pull rope starter and are mounted upon wheels absolutely require that the person starting the machine steps upon the machine to stabilize it. The nature of the horizontal pull while stepping upon the machine is often awkward, and requires the person starting the machine to rotate the torso while bending over. This maneuver has been known to cause serious back injuries, and is difficult for back sufferers and elderly persons to perform, particularly with a stubborn starting machine requiring numerous pulls. The problem is particularly experienced by those performing this starting motion often, such as repairmen and landscapers.

It is therefore an object of the present invention to provide an auxiliary starting device for horizontal rope-pull-start engines associated with small machines.

It is another object of the present invention to provide a starting device of the aforesaid nature which is easily adaptable to a variety of engines, requiring no modification of the machine.

It is a further object of this invention to provide a starting device of the aforesaid nature capable of immobilizing the machine against pulling force applied to the rope starter of the engine.

It is yet another object of this invention to provide a device of the aforesaid nature which is easily disengaged subsequent to starting.

Still other objects of this invention are to provide a device of the aforesaid nature which is simple to use, easily maintained, durable, and amenable to low cost manufacture.

These and other beneficial objects and advantages will be apparent from the following description.

SUMMARY OF THE INVENTION

The above and other beneficial objects and advantages are accomplished in accordance with the present invention by an auxiliary starting device for an internal combustion engine associated with a mobile machine, said engine having a recoil type starter with a clutch and a pull cord having a proximal extremity attached to said starter and a free distal extremity equipped with a pull handle, said machine adapted to rest upon a horizontal surface, said starting device comprised of:

a) a horizontally disposed foundation base elongated between front and rear extremities, b) a support post vertically emergent from said base, c) upper and lower pulleys rotatably held by said post and disposed to rotate in the same vertical plane, d) an activation lever having a lower extremity pivotally attached to said support post at a site between said pulleys, said lever adapted to travel in the vertical plane of said pulleys, e) upper and lower stop means associated with said support post and adapted to define upper and lower contactive limits of travel of said lever, f) an abutment surface associated with the front extremity of said base, g) clamping means adjustably associated with said abutment surface and adapted to immobilize said machine, h) a pulling cable having a first extremity affixed to said lever and a second extremity configured to removably associate with said pull cord handle, said cable passing about said upper and lower pulleys in a manner disposing said second extremity substantially in line with said pull cord, i) a return pulley positioned above said abutment surface and disposed for rotation in a vertical plane, j) a return cable having a first extremity, and a second extremity attached to said pulling cable, said return cable passing about said return pulley, and k) restoring means having a free forward extremity attached to the first extremity of said return cable and a fixedly held rear extremity, whereby, a) downward travel of said lever forces deployment of said pull cord, thereby exerting starting force upon the engine, and b) said restoring means returns the lever to its upper, starting position, and permits the pull cord to return to the engine.

In a preferred embodiment, a horizontally disposed guide chute is provided which slidably supports the pulling cable between the lower and return pulleys. Tether means may be attached to the support post and adapted to release the clutch of the starter. The device is preferably constructed primarily from steel components which are welded or bolted together. The cables may be ⅛" steel or, alternatively, suitably sized nylon rope. The restoring means may be in the form of a helical spring or alternatively elastic bungee cord or band, producing about 10 lbs. of force. The clamping means may include members adapted to prevent movement of the machine toward or away from said starting device. The stop means may be in the form of flexible tethers or rigid abutment members.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figures 1, 2:
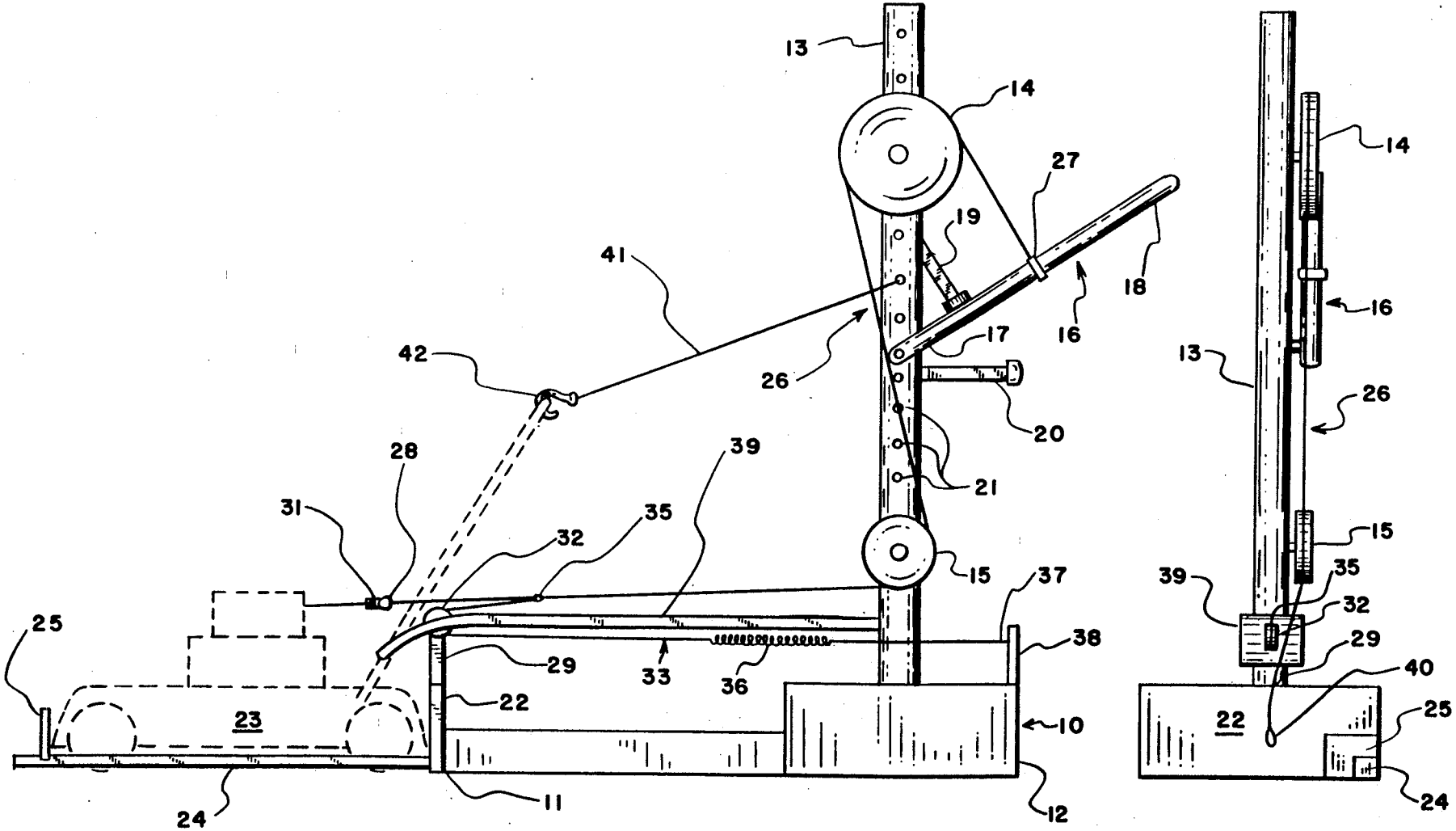
FIG. 1 is a side view of an embodiment of the starting device of the present invention shown in functional association with a lawn mower having a pull-start gasoline engine.
FIG. 2 is a front view of the embodiment of FIG. 1.
Figure 4:
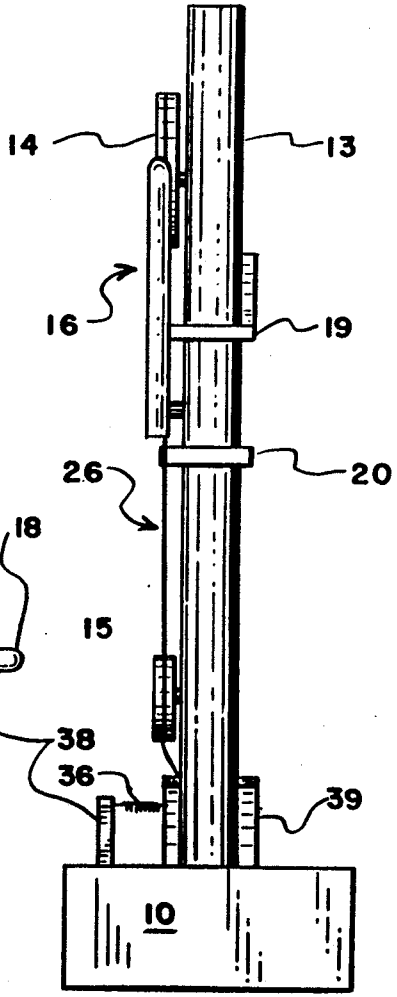
FIG. 4 is a rear view.
Figure 3:
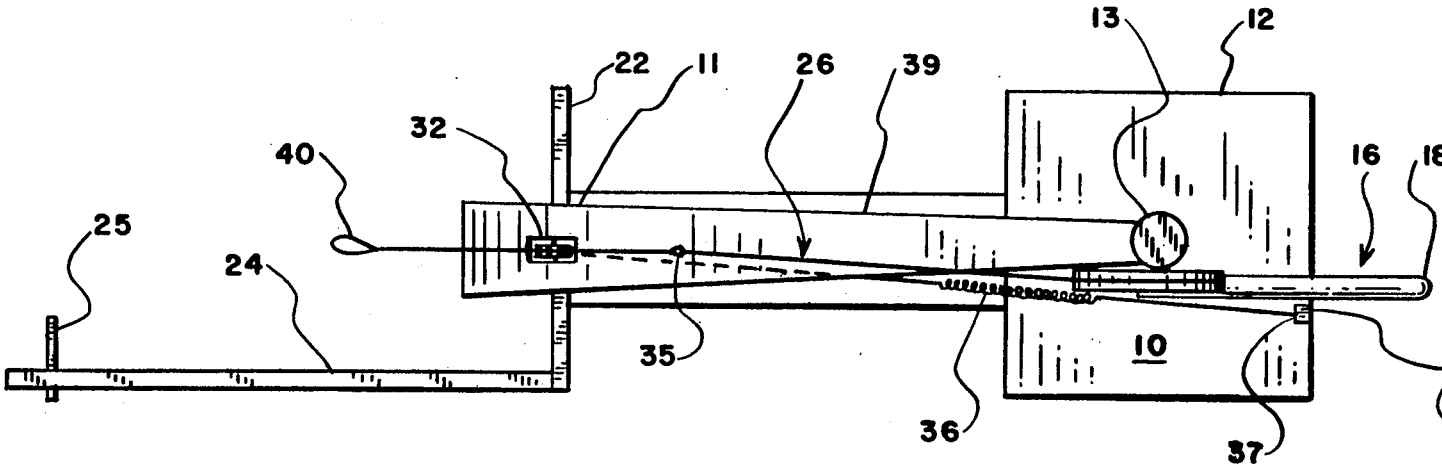
FIG. 3 is a top view of the embodiment of FIG. 1.

Referring to FIGS. 1-4, an embodiment of the starting device of the present invention is shown comprised of a horizontally disposed foundation base 10 elongated between front and rear extremities 11 and 12, respectively, support post 13 vertically emergent from said base, and upper and lower pulley wheels 14 and 15, respectively, secured to said post and disposed to rotate in the same vertical plane. Support post 13 may have a series of apertures 21 adapted to secure various mechanical components at adjustable elevations.

An activation lever 16 having lower extremity 17 and upper extremity 18 is pivotably attached at said lower extremity to post 13 at a site between said wheels. Said lever is positioned so as to be moveable in a circular path in the vertical plane of said wheels. Upper extremity 18 serves as a handle which can be gripped by the operator for the application of downward force.

Upper and lower stop means in the form of brackets 19 and 20, respectively, are secured to post 13 via apertures 21 and positioned so as to abut with lever 16 at upper and lower positions of said lever.

Abutment surface 22 is attached to front extremity 11 of the base. The function of said abutment surface is to prevent a lawn mower 23 from mowing toward post 13. Clamping means in the form of extension bar 24 extending forwardly of surface 22, and bracket 25 adjustably positionable upon bar 24 function to prevent the lawn mower from moving away from abutment surface 22.

Pulling cable 26 has a first extremity 27 affixed to said lever at approximately mid-length thereof, and a second extremity 28 removably associated with the pull cord handle 31 of the lawnmower. Attachment means in the form of a loop 40 is associated with second extremity 28 to facilitate easy and releasible attachment to handle 31. Cable 26 travels upwardly from said lever, passing around the upper portion of upper wheel 14, then travelling downwardly and passing around the lower portion of lower wheel 15 and thence toward the lawnmower at the level of its pull cord.

Support arm 29 is upwardly emergent from abutment surface 22, and terminates in an upper extremity which supports return pulley wheel 32 disposed for rotation in a vertical plane.

Return cable 33 has a first extremity 34, and a second extremity 35 attached to said pulling cable at a site rearwardly spaced from support arm 29, said return cable passing around the lower and forward portions of wheel 32.

Restoring means in the form of coil spring 36 has a free distal extremity attached to the first extremity of cable 33, and a fixed extremity 37 attached to stud 38 extending upwardly from base 10.

A horizontally disposed guide chute 39 is supported by post 13 and support arm 29 at substantially the same elevation as return pulley wheel 32 which is caused to partially protrude through said chute. The function of the guide chute is to enable cable 26 to slide thereupon and prevent any entanglement with underlying return cable 33. Tether means in the form of rope 41 is attached to support post 13 and is provided with hook 42 at its lowermost, free extremity. The tether means enables the operator to disengage the clutch of the starter after the engine is started.

By virtue of the aforesaid components and their interaction, a lawnmower or other comparable mobile machine can be secured at the forward extremity of the base. Pulling cable 26 may then be attached to the pull cord of the engine. A forceful downward pull on the upper extremity of the lever causes a lateral pull on the pull cord with sufficient force to start the engine. Upon release of the lever, the restoring means enables the pull cord to be rewound and the lever returned to its upward position.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. An auxiliary starting device for an internal combustion engine associated with a mobile machine, said engine having a recoil type starter with a clutch and a pull cord having a proximal extremity attached to said starter and a free distal extremity equipped with a pull handle, said machine adapted to rest upon a horizontal surface, said starting device comprised of:

a) a horizontally disposed foundation base elongated between front and rear extremities.

b) a support post extending in a vertical plane emergent from said base, c) upper and lower pulleys rotatably held by said post and disposed to rotate in the same vertical plane, d) an activation lever having a lower extremity pivotally attached to said support post at a site between said pulleys, said lever adapted to travel between the pulleys and substantially in the vertical plane, e) upper and lower stop means associated with said support post and adapted to define upper and lower contactive limits of travel of said lever, f) an abutment surface associated with the front extremity of said base, g) clamping means adjustably associated with said abutment surface and adapted to immobilize said machine, h) a pulling cable having a first extremity affixed to said lever and a second extremity configured to removably associate with said pull cord handle, said cable passing about said upper and lower pulleys in a manner disposing said second extremity substantially in line with said pull cord, i) a return pulley positioned above said abutment surface and disposed for rotation in a vertical plane, j) a return cable having a first extremity, and a second extremity attached to said pulling cable, said return cable passing about said return pulley, and k) restoring means having a free forward extremity attached to the first extremity of said return cable and a fixedly held rear extremity, whereby, a) downward travel of said lever forces deployment of said pull cord, thereby exerting starting force upon the engine, and b) said restoring means returns the lever to its upper, starting position, and permits the pull cord to return to the engine.

2. The starting device of claim 1 further including a horizontally disposed guide chute located below said pulling cable at substantially the same elevation as said return pulley.

3. The starting device of claim 1 further including tether means attached to said support post and configured to disengage the clutch of said starter.

* * * * *